US005472037A

United States Patent [19]

Hoffman

[11] Patent Number: 5,472,037

[45] Date of Patent: Dec. 5, 1995

[54] REINFORCED ACCORDION-TYPE FOLDING SHUTTERS

[76] Inventor: Robert E. Hoffman, 5618 Riviera Dr., Coral Gables, Fla. 33146

[21] Appl. No.: 217,737

[22] Filed: Mar. 25, 1994

[51] Int. Cl.[6] ..... E05D 15/26

[52] U.S. Cl. ..... 160/183; 160/199; 160/118

[58] Field of Search ..... 160/199, 183, 160/201, 186, 187, 196.1, 206, 113, 118

[56] References Cited

U.S. PATENT DOCUMENTS

| | | | |
|---|---|---|---|
| 3,670,797 | 6/1972 | Sassano | 160/183 X |
| 3,901,302 | 8/1975 | Dagenais | 160/183 |
| 4,386,645 | 6/1983 | Dever et al. | 160/183 |
| 4,497,357 | 2/1985 | Labelle | 160/183 X |
| 4,660,613 | 4/1987 | Dagenais | 160/183 X |
| 4,922,987 | 5/1990 | Marontate et al. | 160/183 |
| 5,097,883 | 3/1992 | Robinson et al. | 160/183 |

*Primary Examiner*—David M. Purol
*Attorney, Agent, or Firm*—Harness, Dickey & Pierce

[57] ABSTRACT

A reinforced, accordion-type folding shutter is formed of a substantial number of generally flat, narrow slats that are pivotally joined together, edge-to-edge, for folding and opening the shutter. The adjacent edges of the slats are formed with integral tubes extending substantially their full lengths, but with each of the tubes being notched to form relatively short, co-axially aligned, spaced apart loops. The loops of each pair of adjacent slat edges are interfitted and co-axially aligned and a rigid rod is extended through the aligned loops to form a hinge pin for pivoting each pair of slats relative to each other and, simultaneously, to form, with the surrounding tube loops, a rigid, composite reinforcing bar. A bar is formed at each of the adjacent edges of the slats so that a series of relatively closely spaced bars are formed along the width of the shutter. The bars reinforce the shutter against penetration by wind hurled objects or other forcibly applied impacts.

5 Claims, 2 Drawing Sheets

REINFORCED ACCORDION-TYPE FOLDING SHUTTERS

BACKGROUND OF INVENTION

This invention relates to an improvement to conventional, accordion fold-type shutters which are made of numerous, relatively narrow slats, that are pivotally connected together, edge-to-edge, for closing and opening the shutters. formation of reinforcement bars along the opposite edges of each slat to resist penetration by wind hurled objects or by other applied impacts.

Conventional accordion-type folding shutters are formed of numerous, flat, narrow slats which are arranged edge-to-edge. The adjacent edges of each pair of slats are pivotally connected together, such as by bending the edge of one slat into a generally tubular shape which is rotatably fitted into a larger diameter generally tubular shaped edge of less than 360 degrees in cross-section, which is formed on the next adjacent slat edge. Since the larger tubular shape is considerably less than 360 degrees, an opening is provided, through which the first slat extends. Thus, one tubular shaped edge may be contained within the next adjacent tubular shape, so that the two slats may be pivoted relative to each other.

Normally the slats are arranged vertically, although they may be arranged horizontally for some installations. When the slats are accordion folded relative to each other, the shutter may be moved to an open position. Alternatively, the shutter may be unfolded and extended across an opening, such as a doorway or window opening or the like, when desired.

Shutters of this type are commonly used for both security and to protect against wind hurled objects or other impacts against the shutters. Thus, such shutters are commonly used in areas which are subjected to high velocity wind storms.

In various parts of the country where high velocity wind storms occur from time to time, it has been found that wind hurled objects frequently penetrate conventional shutters and cause damage within buildings that are protected by such shutters. Since conventional shutters are made of relatively thin, extruded or rolled-formed aluminum slats or plastic slats, these shutters may be penetrated by a sufficiently forceful impact.

In order to protect a building which may be subjected to a high wind storm, such as a hurricane, it is desirable to provide shutters which appear to be conventional and which are decorative in appearance, but which have the ability to withstand severe impacts from wind hurled debris or from impacts that might otherwise be applied against the shutters. This present invention relates to an improvement to conventional shutters by substantially reinforcing the shutters so as to increase their resistance to penetration.

SUMMARY OF INVENTION

This invention relates to generally conventional aluminum or plastic shutters which are formed of extruded or roll formed slats that are pivotally connected together, edge-to-edge, for accordion folding the shutter closed. The adjacent edges of the slats are formed as tubes which are notched to provide short length loops, with the loops of one slat edge interfitted between, and co-axially aligned with, the loops of the adjacent slat edge. A strong, rigid rod is extended through, and snugly fitted within the aligned loops to provide both a hinge pin, about which the loops may pivot, and a composite reinforcing bar together with the aligned loops. That is, the loops form a sectional tube containing a rigid filler which forms a reinforcing bar.

The interfitted tubular loops and rods provide reinforcing bars at each of the opposite edges of each of the slats. Since the slats are narrow, in effect, the shutter is provided with numerous, closely spaced reinforcing bars along its width. These closely spaced bars resist penetration of the shutter.

One object of this invention is to provide a series of closely spaced, reinforcing bars, along the full width of a shutter, of the accordion-fold type, which bars reinforce the shutter and resist the penetration of the shutter by wind hurled objects or by other forcefully applied objects.

Another object of this invention is to provide an inexpensive, unobtrusive system for reinforcing what appears to be a conventional accordion-type folding shutter, with numerous bars extending the full length of the slats forming the shutter to resist penetration by forcefully applied objects.

Still another object of this invention is to provide a relatively simple construction which, unobtrusively, provides a series of closely spaced parallel bars which resist penetration of the shutter by either wind hurled or manually applied objects when the shutter is extended over a building opening.

These and other objects and advantages of this construction will become apparent to those skilled in the art upon reading the following description of which the attached drawings form a part.

DETAILED DESCRIPTION

Figure 1:
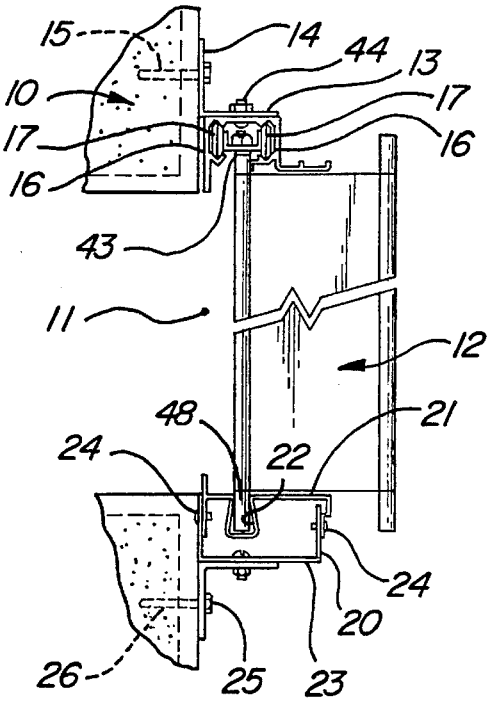
FIG. 1 is a cross-sectional, elevational view of the shutter mounted upon a wall to cover a window opening.
Figure 2:
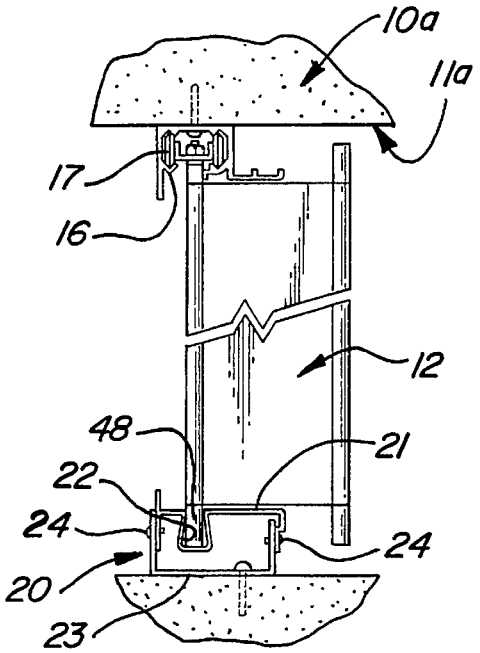
FIG. 2 is a cross-sectional, elevational view showing the shutter mounted over a building doorway opening.
Figure 3:
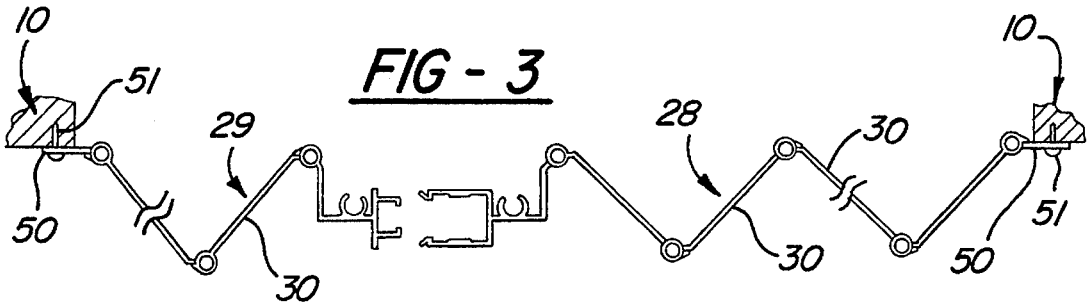
FIG. 3 is a cross-sectional, plan view, showing the shutter extended over an opening and with the two sections of the shutter about to be connected at the center of the shutter.
Figure 4:
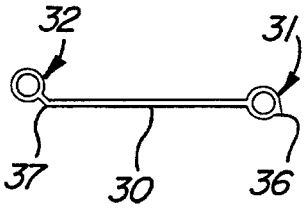
FIG. 4 illustrates an end view of a single shutter slat.
Figure 5:
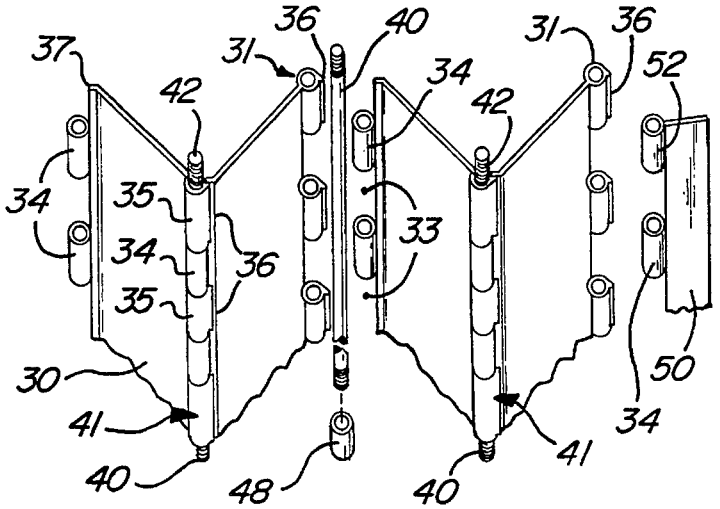
FIG. 5 is a perspective view of a fragment of the shutter showing some of the slats interconnected and others about to be connected together.
Figure 6:
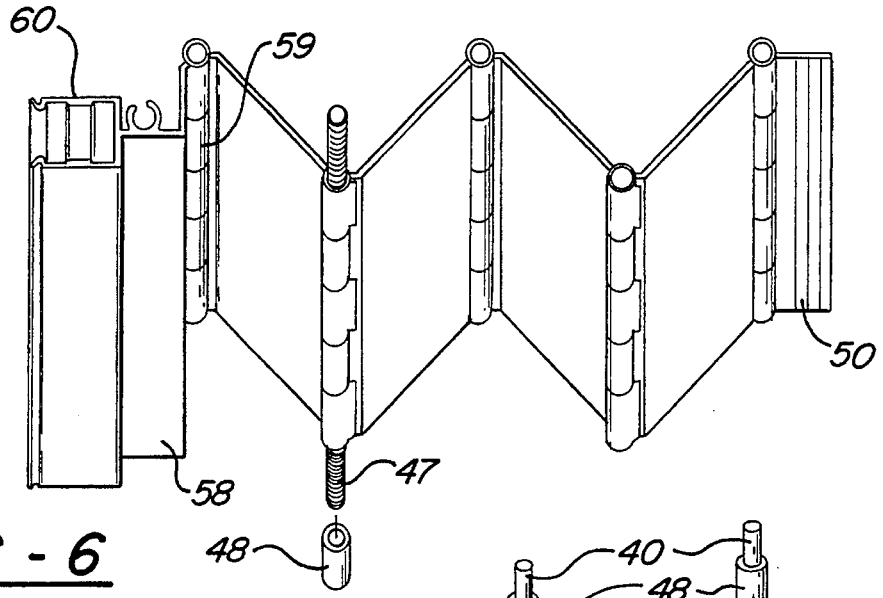
FIG. 6 is a perspective view of a portion of the shutter extended.
Figure 7:
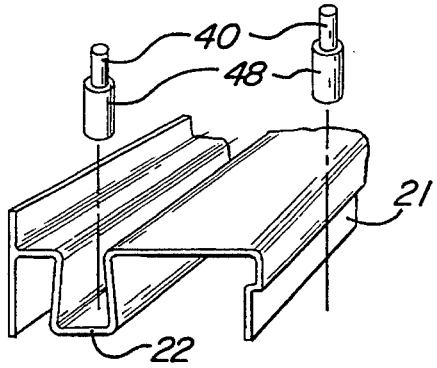
FIG. 7 is a perspective view of the lower guide track or guide member.
Figure 8:
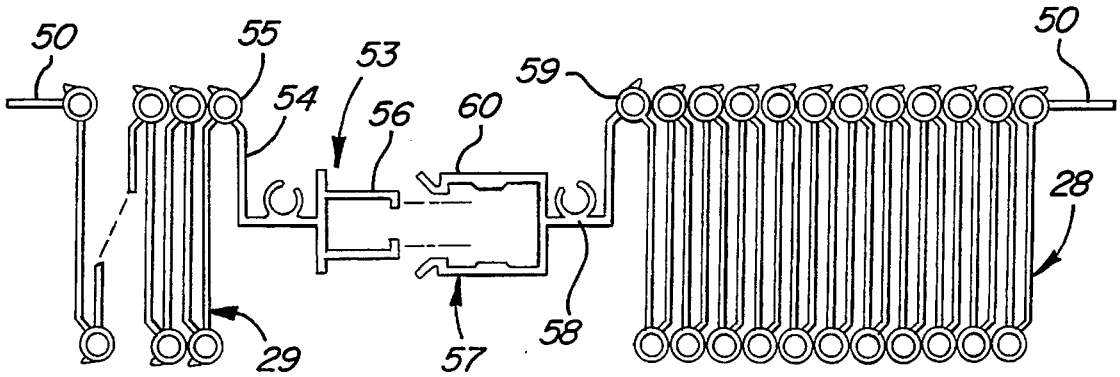
FIG. 8 is a plan view of one of the shutter halves folded together for clearing the building opening over which the shutter is mounted.
Figure 9:
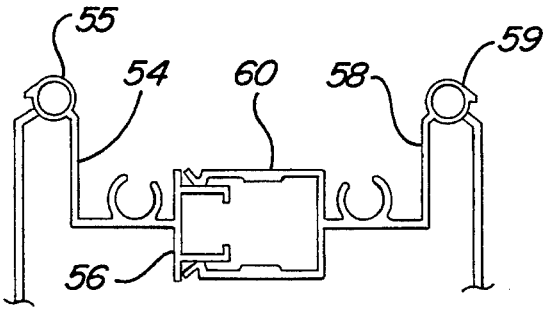
FIG. 9 is a fragmentary, plan view, showing the two shutter halves connected together.

A building construction 10 is schematically shown in FIG. 1. The construction includes a window opening 11. A shutter, generally designated 12, is arranged to cover the window opening. FIG. 2 illustrates a similar building construction 10*a* having a doorway opening 11*a*.

Referring to FIG. 1, shutter 12 is suspended from an upper guide track 13 which extends along the top of the window opening. The track is provided with a flange 14 which is fastened to the adjacent building structure located above the window opening, by means of suitable screws or other mechanical fasteners 15. The track includes a pair of opposed support flanges 16 which support a pair of shutter support wheels 17. These wheels roll along the support flanges for opening and closing the shutter.

A box-like lower guide track 20 is secured along the lower edge of the window opening. This track is provided with an inverted U-shaped upper section 21 which has a bent or pre-formed guide channel 22 extending along its length. In addition, the track includes a lower, U-shaped section 23 which is connected, by screws or rivets 24, to the upper section 21. The guide track may be provided with a mounting flange 25, or with a separate angle bracket, which is fastened to the lower section 23 and to the adjacent wall structure by means of suitable mechanical fasteners 26, such as screws or the like.

The shutter may be formed as a single unit or may be formed, as illustrated and described below, of two separately moveable, aligned shutter sections 28 and 29. Each section is formed of a number of substantially identical slats 30. Each slat is provided with an integral tube 31 on one edge and an integral tube 32 on its opposite edge. Preferably, the slats are extruded out of aluminum or plastic so that the tubes are extruded integrally with the slat body.

Each of the tubes are notched along its length to provide spaces 33 that form separate spaced apart, tube loops 34 and 35. The loops 34 of one slat edge fit into the notches or spaces 33 of the adjacent slat edge. The loops formed on one edge of each slat are formed with an integral stop or projection 36. The loops on the slat opposite edge are connected to the slat body by an offset bent strip 37.

As illustrated, the loops on one slat edge are co-axially interfitted with the loops on the adjacent slat edge to form a sectional tube. An elongated, rigid steel or aluminum rod 40 is inserted within the tube formed of the co-axially aligned loops. The rods are closely fitted within their surrounding loops, but are loose enough to allow the loops on one slat to pivot, in a hingelike fashion, relative to the loops on the adjacent slat. The relatively snug fit between the adjacent loop ends, as well as of the rod within the loops, produces a composite reinforcing bar 41 at each edge of each of the slats. These composite reinforcing bars, which are made up of a rigid filler (i.e. the rod) and the surrounding loops, provide closely spaced reinforcing bars along the full width of the shutter.

The opposite ends of the rods extend outwardly of the loops. Thus, an upper, threaded rod extension 42, is formed at the upper end of each of the bars. These rod extensions connect to a metal bracket 43 upon which the wheels 17 are rotatably mounted. The rod extensions may be fastened to the bracket by means of conventional threaded nuts 44.

The lower ends of each rod form rod extensions 47 which, preferably, are threaded, are covered by interiorly threaded caps 48. These caps fit into the guide channel 22. Every other cap fits into the guide channel 22. The intervening caps are arranged on the outside of the lower guide track, as illustrated in FIGS. 1 and 2.

Each of the slat sections terminate in an end strip 50 which is attached to the adjacent opening jam structure by means of screws or fasteners 51. The end strips are also provided with loops 52 which interfit with the adjacent slat loops. In the construction shown, where the shutter is made of two separate shutter sections, each section has an inner coupling member or rail for coupling the two sections together when the slats are extended to cover the building opening. One section has an inner coupling member 53, which has an integral flange 54, and loops 55, that are interfitted with the adjacent loops of one of the slats. The inner coupling member is provided with an inner channel shaped member 56.

The other shutter section has an outer coupling member 57, having a flange 58, and loops 59, that are interfitted with the loops of its adjacent slat. The outer coupling member is formed with an outer channel member 60 which receives the inner channel member 56. That is, the inner channel member 56 is smaller, i.e. more narrow, than the outer channel member 60, for snugly fitting within the outer channel member.

A suitable, conventional, lock may be provided on the channel members for connecting them together. However, this is not illustrated as it forms no part of this invention.

The arrangements of the shutter upon the building construction, with the guide tracks fastened either along the upper and lower edges of a window opening (see FIG. 1) or along the header and the sill areas of a door-like opening (see FIG. 2), are conventional. The overall appearance of the shutter is essentially the same as a conventional accordion-fold type shutter. Thus, a viewer, casually observing the shutter, would probably not detect the difference between the present reinforced shutter and a conventional shutter. The reinforcement of the shutters by the composite bars formed of the loops and rods, is unobtrusive. Yet, the bars provide the rigidity and strength to resist penetration by wind hurled or otherwise forcefully applied objects.

The sizes of the slats may vary considerably. For example, each slat may be on the order of approximately 2 inches in width and of a height sufficient to cover an opening in a building, whether of a doorway type or of a window type opening. The thicknesses of the slats may vary considerably. By way of example, they may be roughly ⅛th inch in thickness. As an example of a suitable reinforcing rod, a ⅜th inch diameter stainless steel rod may be used. The distances between the bars will depend upon the width of the slats which may vary in accordance with the particular appearance and structural strength desired for a particular installation.

The shutter may be made of a single section, rather than of a pair of sections, as illustrated. While particular ways to mount the shutter upon a building structure are illustrated, other shutter mounting systems or guide tracks may be used. In every instance, however, it is contemplated that the reinforcing bars, which are provided by the composite, co-axially aligned, loops and rods, will be relatively closely spaced to provide numerous bars along the shutter. The shutter may be mounted either vertically or horizontally. That is, normally the slats are vertical but, in some instances, the slats may be horizontal and, therefore, may be moved upwardly and downwardly. In either arrangement, the close proximity of the composite bars resists almost all anticipated hurled objects which may be thrown by high winds, during a high wind storm or, alternatively, may be manually applied.

This invention may be further developed within the scope of the following claims. Accordingly, it is desired that the foregoing description be read as being merely illustrative as an operative embodiment of this invention and not in a strictly limiting sense.

I claim:

1. A reinforced accordion-type folding shutter formed of a number of substantially identical, vertically extending, aligned, narrow slats having their adjacent edges pivotally connected together for permitting folding and opening the shutter, comprising:

each slat being generally in the shape of an elongated, flat strip with its opposite vertical edges formed in a generally tubular shape which is integral with and extends substantially the full length of the respective slat edge;

each slat edge tube being notched along its length to provide numerous, spaced apart, generally equal length loops, whose lengths are greater than the diameters of the loops, and with the spaces formed by the notches between each adjacent pair of loop ends being of a length to receive the corresponding loops formed on the edge of the next adjacent slat and with the loops of each adjacent pair of slats being co-axially aligned to form a single tube made of alternating loops;

a rigid rod extending through the aligned loops of each pair of adjacent slats edges to form a rigid hinge pin which together with the aligned loops form a hinge for pivoting the slats relatively to each other and, simultaneously, to form a rigid, composite bar formed by the co-axially aligned loops and rod, which bar extends substantially the full height of the shutter;

each rigid rod extending a short distance above and a short distance below its respective slats and a guide member positioned above the slats and secured with said rod for receiving and guiding the upper extensions of the rods and a guide member located beneath the shutter and secured with said rod for guiding the lower extensions of the rods when the shutter is moved into open and closed positions;

whereby the shutter is provided with a series of closely spaced reinforcing bars for resisting penetration by wind hurled objects or other forcibly applied objects.

2. A construction as defined in claim 1 and including stops formed integrally on the loops located on one edge of each slat, with said stops arranged to contact and stop the movement of the adjacent slat when the shutter is opened.

3. A reinforced accordion-type folding shutter formed of a number of substantially identical, generally flat, narrow slats arranged edge-to-edge and pivotally joined together along their edges for permitting folding the shutter and for opening the shutter, comprising:

each slat having an integral tube formed on its side edges and extending substantially the full height of the slat;

the tubes of the slats being notched along their lengths to provide alternating spaces and loops, with the loops and spaces being generally larger than the diameter of the tubes;

the loops of the adjacent edges of an adjacent pair of slats being interfitted so that they are co-axial, relative to each other, to form an elongated, sectional tube;

a rigid rod extending through the aligned loops at each adjacent pair of slat edges for simultaneously forming a hinge pin for pivoting the slat loops relative to each other, and thereby permitting the slats to be pivoted, and to form a rigid, multi-layer bar comprised of the aligned vertical loops and the rods contained within loops, which extend substantially the full length of the slats;

each rigid rod extending a short distance above and a short distance below its respective slats and a guide member positioned above the slats and secured with said rod for receiving and guiding the upper extensions of the rods and a guide member located beneath the shutter and secured with said rod for guiding the lower extensions of the rods when the shutter is moved into open and closed positions;

whereby the shutter is provided with a series of closely spaced bars, that is, bar-like formations along each of the slat side edges, for reinforcing the shutter to resist penetration by wind hurled objects or by other forcibly applied impacts against the shutter.

4. A reinforced accordion-type folding shutter as defined in claim 3, including said interfitted loops being relatively snugly interfitted so as to permit rotation of the loops of one slat relative to the loops of its interfitted adjacent slat edge, but generally providing a substantially rigid bar-like formation comprised of the co-axially aligned interfitted loops which are closely fitted together to provide a substantially complete tube which surrounds the rod located within the aligned loops, to produce a series of substantially rigid bars along the width of the shutter.

5. A construction as defined in claim 4 and including stops formed integrally on the loops located on one edge of each slat, with said stops arranged to contact and stop the movement of the adjacent slat when the shutter is opened.

* * * * *

UNITED STATES PATENT AND TRADEMARK OFFICE

CERTIFICATE OF CORRECTION

PATENT NO. : 5,472,037

DATED : December 5, 1995

INVENTOR(S) : Robert E. Hoffman

It is certified that error appears in the above-indentified patent and that said Letters Patent is hereby corrected as shown below:

Column 1, line 9, insert --In particular, the improvement relates to the-- before "formation".

Signed and Sealed this

Twenty-fifth Day of June, 1996

*Attest:*

Bruce Lehman

BRUCE LEHMAN

*Attesting Officer*

*Commissioner of Patents and Trademarks*